US006955217B2

(12) United States Patent
Clark et al.

(10) Patent No.: US 6,955,217 B2
(45) Date of Patent: Oct. 18, 2005

(54) METHOD AND APPARATUS FOR A TUBING CONVEYED PERFORATING GUNS FIRE IDENTIFICATION SYSTEM USING FIBER OPTICS

(75) Inventors: John Clark, Aberdeen (GB); Jamie Oag, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/440,514

(22) Filed: May 16, 2003

(65) Prior Publication Data

US 2004/0020645 A1 Feb. 5, 2004

Related U.S. Application Data

(62) Division of application No. 09/749,166, filed on Dec. 27, 2000, now Pat. No. 6,564,866.

(51) Int. Cl.[7] ..... E21B 43/116; E21B 43/119

(52) U.S. Cl. ..... 166/250.01; 166/66; 166/55.1; 73/35.14; 250/259

(58) Field of Search ..... 166/55, 55.1, 66, 166/250.01, 297; 73/35.14, 152.59; 250/259

(56) References Cited

U.S. PATENT DOCUMENTS

| | | | | |
|---|---|---|---|---|
| 4,208,966 A | | 6/1980 | Hart | |
| 4,264,329 A | | 4/1981 | Beckett | |
| 4,478,294 A | | 10/1984 | Sumner | |
| 4,614,156 A | * | 9/1986 | Colle et al. | 102/312 |
| 4,650,010 A | * | 3/1987 | George et al. | 175/4.52 |
| 4,660,638 A | * | 4/1987 | Yates, Jr. | 166/55.1 |
| 4,966,233 A | | 10/1990 | Blount et al. | |
| 5,062,485 A | * | 11/1991 | Wesson et al. | 166/297 |
| 5,407,009 A | | 4/1995 | Butler et al. | |
| 5,413,045 A | * | 5/1995 | Miszewski | 166/63 |
| 5,979,245 A | | 11/1999 | Hirano et al. | |
| 6,105,688 A | | 8/2000 | Vaynshteyn et al. | |
| 6,125,934 A | | 10/2000 | Lenn et al. | |
| 6,281,489 B1 | * | 8/2001 | Tubel et al. | 250/227.14 |
| 6,520,255 B2 | * | 2/2003 | Tolman et al. | 166/281 |

FOREIGN PATENT DOCUMENTS

| | | |
|---|---|---|
| GB | 2340157 | 2/2000 |

* cited by examiner

*Primary Examiner*—David Bagnell
*Assistant Examiner*—Shane Bomar
(74) *Attorney, Agent, or Firm*—Madan, Mossman & Sriram, P.C.

(57) ABSTRACT

A method and apparatus for determining whether a tubing conveyed perforating (TCP) gun has fired by detecting a change in characteristics of the flow of an oil well. A method and apparatus detects the presence of fluorescent tracer dye to determine whether or not a TCP gun has fired. The method and apparatus detects a change is capacitance, or fiber optic electrical properties to determine whether or not a TCP gun has fired. The method and apparatus detects the number of charges fired to determine whether or not all TCP guns have fired and also provides a method and apparatus for determining the contributions of injection wells to producing wells by introducing fluorescent tracers into injection wells and detecting the presence of the fluorescent tracers at production wells. A method and apparatus is provided for placing fluorescent dye particles in a gravel pack to sense when a gravel pack is deteriorating by detecting the tracer dye particles in the well flow.

19 Claims, 2 Drawing Sheets

PACKING DETERIORATION SYSTEM

METHOD AND APPARATUS FOR A TUBING CONVEYED PERFORATING GUNS FIRE IDENTIFICATION SYSTEM USING FIBER OPTICS

CROSS REFERENCE TO RELATED APPLICATIONS

This patent application is a divisional and claims priority from U.S. patent application Ser. No. 09/749,166 filed on Dec. 27, 2000 now U.S. Pat. No. 6,564,866 entitled "A Method and Apparatus for a Tubing Conveyed Perforating Guns Fire Identification System Using Enhanced Marker Material" by Clark et al.

BACKGROUND OF THE INVENTION

1. Field of the Invention

The present invention relates to the field of perforating guns used in a down hole oil well environment and in particular to a method and apparatus for using flourescent dyes to determine whether or not a tubing conveyed perforating (TCP) gun charge has fired.

2. Background of the Related Art

During the completion phase of an oil well, perforating guns containing explosive charges are lowered into the wellbore below the casing. Upon detonation the charges blast a hole in the casing, cement and reservoir rock, thereby enabling hydrocarbons in an adjacent hydrocarbon formation to flow into the wellbore for recovery. The conventional method for determining whether the perforating guns have successfully fired is to monitor changes in well bore pressure. Unfortunately, pressure monitoring can only indicate that one or more of the guns have fired (and not always reliably), but cannot determine or whether or not all of the guns have fired successfully. At present there is no known technology available for verifying whether each of the individual perforating guns have fired and hence, there is a lack of reliable quantitative downhole data in this regard. Without useful and reliable data, the decision making process is impaired, with attendant detrimental operational and economic effects. It is imperative that all downhole tubing conveyed perforating guns fire and penetrate the casing to optimize hydrocarbon flow and recovery from the adjacent formation. Thus, there is a need to reliably determine whether each of the perforating guns have successfully fired.

SUMMARY OF THE INVENTION

The present invention provides a method and apparatus for determining whether a tubing conveyed perforating (TCP) gun has fired by detecting a change in characteristics of the flow of an oil well. In one embodiment the present invention detects the presence of fluorescent tracer dye to determine whether or not a TCP gun has fired. In another embodiment the present invention detects a change is capacitance, or fiber optic electrical properties to determine whether or not a TCP gun has fired. In another embodiment of the present invention a method and apparatus is provided that detects the number of charges fired to determine whether or not all TCP guns have fired. The present invention also provides a method and apparatus for determining the contributions of injection wells to producing wells by introducing fluorescent tracers into injection wells and detecting the presence of the fluorescent tracers at production wells. In another embodiment of the present invention, a method and apparatus is provided for placing fluorescent dye particles in a gravel pack to sense when a gravel pack is deteriorating by detecting the tracer dye particles in the well flow.

DETAILED DESCRIPTION OF A PREFERRED EMBODIMENT

Figure 1:
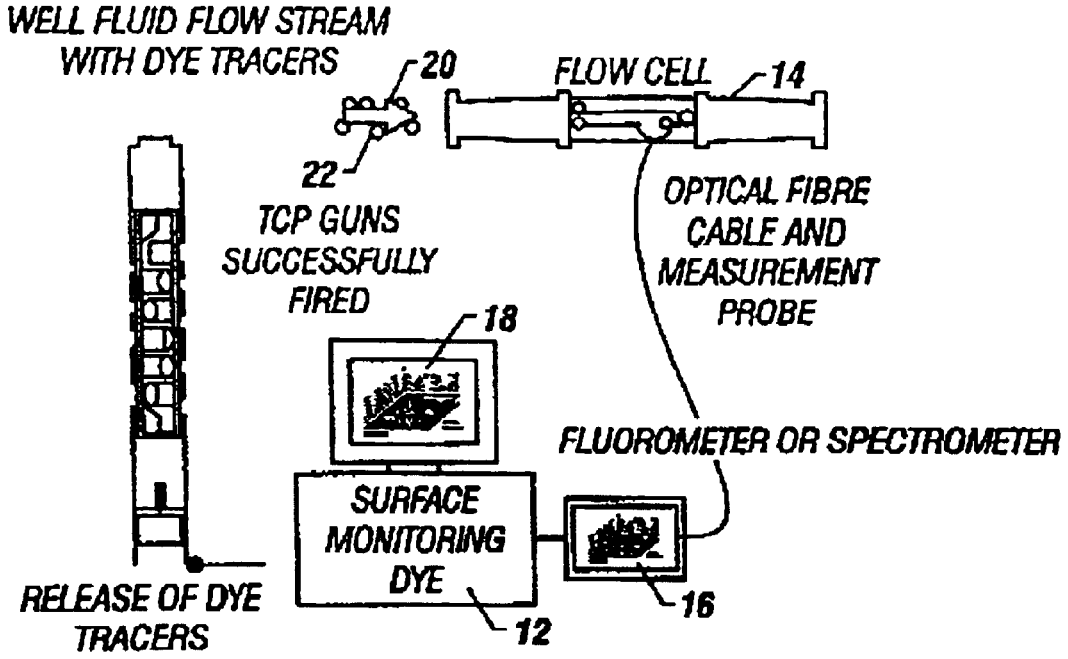
FIG. 1 is an illustration of a method and apparatus for tracking flow from an oil well.

The present invention provides a method and apparatus for determining whether a tubing conveyed perforating gun (TCP) has fired using an enhanced fluorescent marker material for TCP guns and a downhole and/or surface mounted detection system. The system of the present invention is field portable. The present invention provides on-board software, which enables real-time monitoring which enables non-experts to utilize field-generated data to determine whether each of the perforating guns have fired successfully.

The innovative system of the present invention provides a reliable real-time quantitative indication of the downhole status of the wellbore following an attempted TCP gun firing. The system also enables the operator to make an immediate informed decision following TCP gun operation as to the success of the attempted perforation. The benefits and advantages of the present invention include reduction of operational drilling costs by minimizing rig downtime and decreasing the number of runs in hole, enabling a well to be brought on line earlier without unnecessary delays and restarts associated with false starts due to attempted recovery after unsuccessful TCP gun operations.

These advantages are paramount in today's market where service companies often offer little substantial difference in technical capability of TCP guns. The major distinction is reflected in the provision of the perforating service and reliability of that service. Innovative and distinctive features of the new system provided by the present invention include adoption of micro-encapsulated fluorescent tracers, the use of flow cells or fibre optic probes for tracer detection, communication between downhole well and surface equipment, a unique surface reporting software package, and the creation of a simple reliable system that performs consistently in the harsh downhole environment of the well bore.

There are no known comparable technologies for successfully determining the status of an attempted TCP gun perforation. In an alternative embodiment, the TCP gun firing detection and identification system comprises an acoustic, ultrasonic or capacitance method of determining the status of an attempted perforation. The present invention fills the void of uncertainty surrounding the status and success of perforating operations. The present invention provides a unique solution, in an area where no known device or technology is presently available.

The basic operating principle behind the TCP Gun Fire Identification System (FIS) of the present invention is to provide a fluorescent indicator module and/or dummy charge/shot that is fitted into a TCP gun string. Within the module and/or dummy charge/shot a capsule containing an enhanced marker material (fluorescent tracers—micro-encapsulated, pigments, liquid/fluid dyes and solid dye tracers, e.g. glass, plastic, polymer, ceramic, organic compound/s) is ruptured by the TCP gun explosive charge. The fluorescent dye particles are embedded or encapsulated within the polymers, glasses and ceramics of the fluorescent indicator module to create a stable, unique and distinctive fluorescent dye tracers. Each dye tracer has a specific excitation and emission spectra, thus enabling several different dye tracers to be used in conjunction and distinctly detected the same time using highly sensitive optoelectronic instrumentation to determine whether or not a particular TCP gun associated with a particular dye tracer has fired.

Hence, when the TCP guns successfully fire, the dye tracers release into the well/reservoir flow stream (fluid and/or gas e.g. hydrocarbon, diesel, mud, brine and water, also including gas condensate or gas stream) within the well casing. After the initial perforating of the casing and reservoir formation, the well is flowed (the minimum of casing volume) to the surface process plant. The process flow stream is analyzed by a surface mounted monitoring instrument (fluorometer), which detects each dye tracer to verify that each associated TCP gun has successfully fired.

In an alternative embodiment, a downhole tracer detection sensor module is provided for a quicker response time as the tracer detection sensor is installed closer to the source, i.e., tracers module and provides almost instantaneous and direct analysis. This tracer detection data is transmitted optically, electrically, digitally, acoustically via wireless or analog to the surface instrumentation for storage and display. The tracer detection/TCP firing data can also be stored downhole with memory gauges and/or electronic storage devices. The sensor module further comprises an energy storage device coupled to a signal receiver and an electronic control assembly. The energy storage device comprises any available energy source, for example a battery, fuel cell, a capacitor, power cell or Thermophotovoltaic (TPV) cells which convert heat into electricity.

A fibre optic fluorometer/spectrometer instrument is also provided to determine the concentration and distribution of dye tracers within the harsh conditions of the hydrocarbon process flow stream. A flow cell, fibre optic Probe and/or sensor enables detection of tracer concentrations as low as 10 ppb. A particular fluorescent dye tracer detection count is used as a semi-quantitative indicator when dye/tracer coverage is used to determine the percentage relative flow analyzed in profile or cross section. The present invention provides automated analysis, calibration, and mapping of the spread of tracers introduced into the process stream. The combination of fluorescent dye tracers and real-time process monitoring of tracer type, size and concentration provide new and innovative applications of process stream analysis.

Fluorescence is the molecular absorption of light energy at one wavelength and its nearly instantaneous re-emission at another, usually longer wavelength. Some molecules fluoresce naturally and others can be modified to make fluorescent compounds. Fluorescent compounds have two characteristic spectra: an excitation spectrum (the amount of light absorbed) and an emission spectrum (the amount of light emitted). These spectra are often referred to as a compound's fluorescence signature or fingerprint. No two compounds have the same fluorescence signature. It is this uniqueness that enables fluorometry to be used as a highly specific analytical technique. Fluorometry is chosen for its extraordinary sensitivity, high specificity and low cost relative to other analytical techniques. Moreover, fluorometry is ordinarily 1000-fold more sensitive than conventional absorbance measurements. Fluorometry is a widely accepted and powerful technique that is used for a variety of environmental, industrial and biotechnology applications. Fluorometry is a valuable analytical tool for both quantitative and qualitative analysis.

Figure 2:
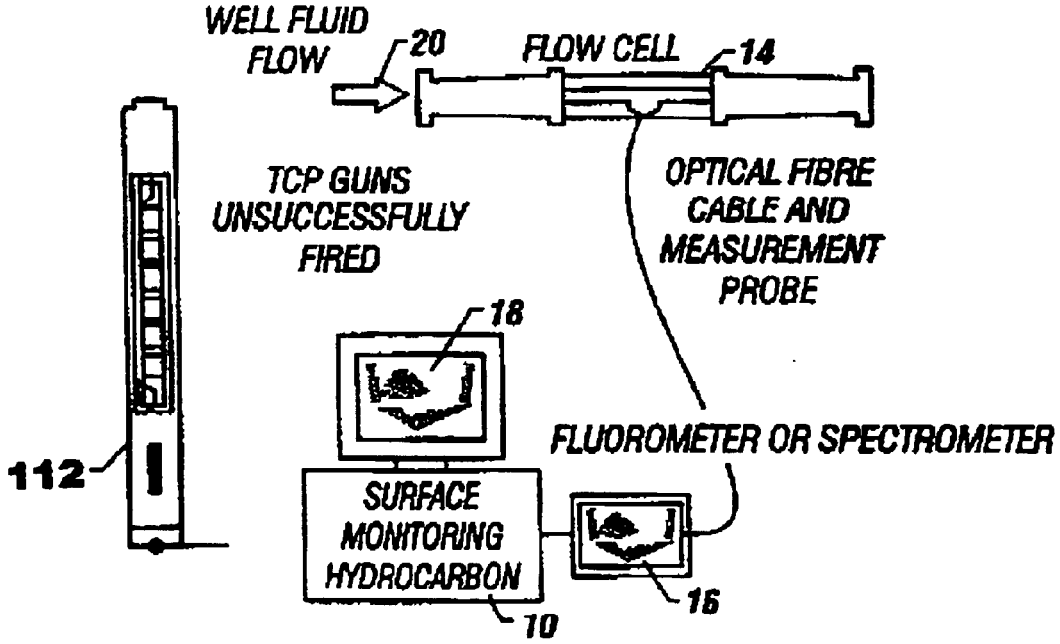
FIG. 2 is an illustration of the preferred method and apparatus for determining whether a tubing conveyed perforating gun has fired.

As shown in FIG. 1, data logging software 10 detects and displays online monitoring for hydrocarbons 20 only. From this diagnostic information, an appraisal can be made as to whether the TCP guns have unsuccessfully fired. That is if there is no flow the guns have not successfully fired. As shown in FIG. 2, the preferred data logging and monitoring software 12 shows dye tracers 22 as they are monitored and measured by flow cell 14 and Fluorometry 16. The results are displayed on surface monitor/computer 18. The configuration of FIG. 2 detects the presence of tracers 22 among flowing hydrocarbons 20. From this diagnostic information, a determination is made as to whether the TCP guns have successfully fired.

In an alternative embodiment, TCP Guns Fire Identification module/devices are provided comprising alternative technologies. In a first alternative embodiment, a capacitance measurement (detects changes in capacitance of the gun casing and/or tool string) module sensor is provided for storing, receiving and transmitting capacitance change data/information to a collection system for analysis to determine whether a TCP gun has fired. In this alternative embodiment, as shown in FIG. 2, a sleeve unit 112 is provided which fits around the TCP gun string. The sleeve is made of a material/s that is ferrous and/or composite (e.g. plastic, ceramic, carbon fibre and Kevlar) and/or hybrid of any of the stated above. These materials within the sleeve or the sleeve itself, would change capacitance/conductance values/states when the TCP guns discharge and remove the material from the sleeve. Any material which changes capacitance when the TCP gun fires is suitable.

In another alternative embodiment, an ultrasound, seismic and/or acoustic measurement module sensor is provided to measure the number of explosive gun charges/shots that have been fired by storing, receiving and transmitting this data/information to a collection system for analysis. The receiver and transmitting device/probe is within the downhole tool or positioned within the casing and/or the casing and riser itself. This receiver/transmitter is utilized to transmit the acoustic detection data to a surface receiver. Alternatively, a receiver and transmitting device/probe would be deployed externally of the casing i.e. external to the well, sea and/or seabed.

In yet another alternative embodiment of the present invention, a fibre optic device is embedded, fixed and/or glued onto or into the TCP gun string or alternatively a sleeve unit is designed/built, which fits around the TCP gun string and placed in direct line of fire of explosive gun charges/shot. The fibre optics is distorted/broken at each successful fired gun charge/shot. The difference in each fibre optic/cable length is then determined, electrically and analyzed to identify which charges/shot has fired, by using time of flight instrumentation/device (light source from lamp, LED's and/or laser module device/sensor).

In another alternative embodiment, a simple optic system is provided which comprises a fitting/placing fibre optic/s on the last TCP gun charge/shot on each gun string. This optic system identifies when last gun charge/shot has successfully fired (identifying that all or most of gun charges/shots within each gun string have fired—top to bottom) when the fibre/s are broken. In an alternative embodiment, the fibre optic/s and/or fibre optic probe are used as a sensor which measures a sensed change as an indicative event. A change or no change in the following parameters: temperature, pressure, light (e.g. absorbance, transmission, fluorescence, irridiation and ablation) (flash from explosive charge) is indicative of successful firing. Also colors, sounds, energy (electromagnetic, electrical, thermal), hydrostatics, chemicals, forces, stresses, strains and/or displacements of solid objects and/or fluids can be analyzed and/or measured as TCP firing indicators.

The data from each of the alternative embodiment, module/devices and sensors is transmitted optically, electrically, digitally, or acoustically via wireless or via some other analog or digital method of downhole transmission and/or transmitted to the surface instrumentation/storage devices. The TCP firing data could also be stored downhole with memory gauges and/or electronic storage devices.

The present invention provides unique software for real-time monitoring and data display manipulation options. Data logging points are filed and stored directly in the surface or downhole computer's memory. The downloaded data will be stored in ASCII format and imported directly into a standard spreadsheet program and linked to self-generating field report software. Using the software provided parameters, such as data collection intervals, graphical display and detection limits are easily selected for display and printing.

Figure 3:
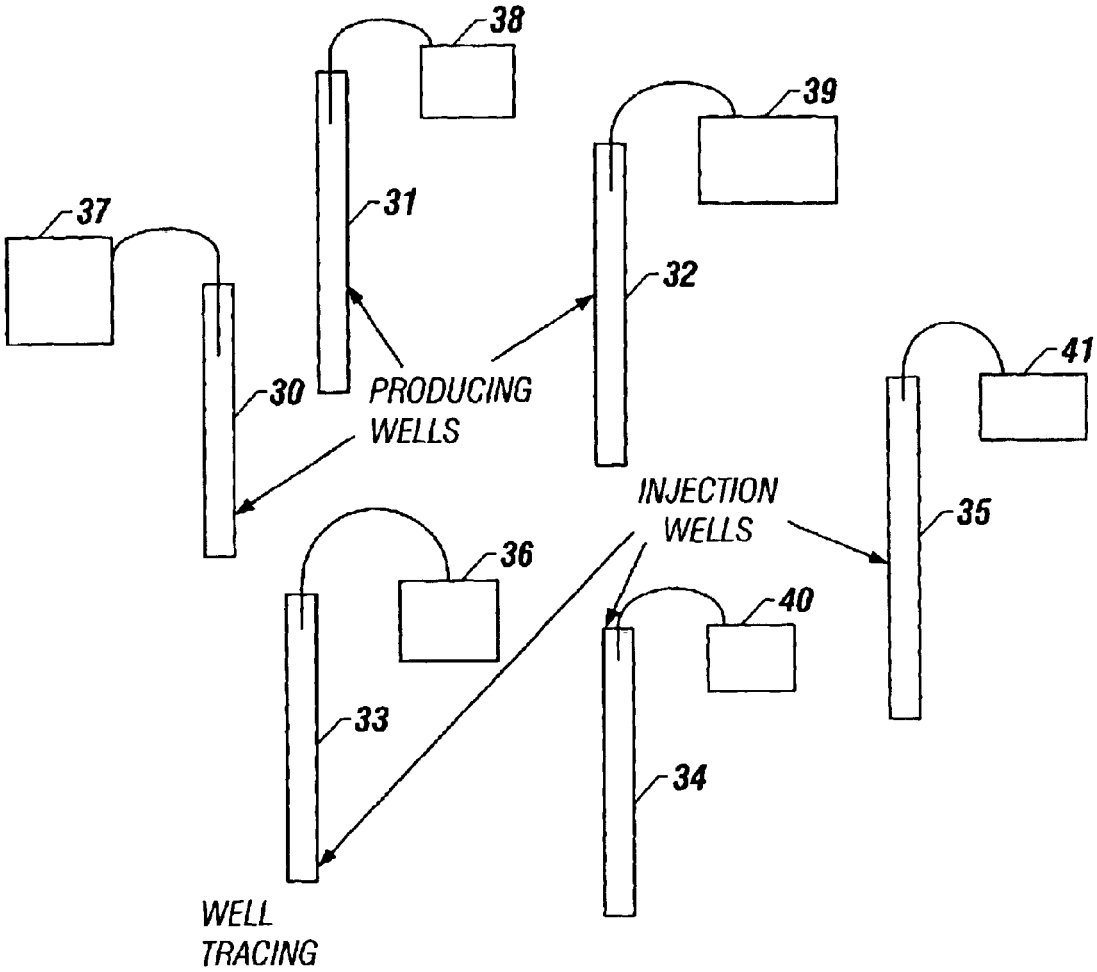
FIG. 3 is an illustration of a preferred injection well tracing method and apparatus of the present invention.

As shown in FIG. 3, the method and apparatus of the present invention can also be utilized to assist in developing reservoir models where injection wells 33, 34, and 35 are used to support producing wells 30, 31 and 32 in the same reservoir or field. By injecting different fluorescent materials into each of the injection wells using injectors 36, 40 and 41 and monitoring the flow lines of each producing well at monitors/detectors 37, 38, 39 it is possible to determine which injection wells are providing support for each producing well. Additionally it is possible to generate an indication at detectors 37, 38, 39 of the percentage flow from each injection well 33, 34 and 35 by monitoring at any or all of detectors 37, 38, 39 the volumes of each type of fluorescent material deposited in each injection well 37, 38, 39 at any given producing well 30, 31, 32. Monitoring systems 37, 38 and 39 enable all producing wells in a field or reservoir it is possible to map the water flood in greater detail and with higher accuracy than previously.

Figure 4:
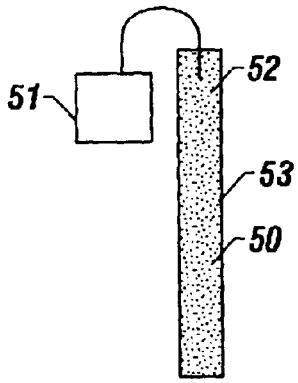
FIG. 4 is an illustration of a preferred packing deterioration detection system of the present invention.

As shown in FIG. 4, the present invention enables monitoring at detector/monitor 51 the efficiency of gravel packs 50 in producing wells 53, by sizing the fluorescent capsules 52 so that, should the gravel 50 pack begin to deteriorate, the first sign of failure would be traces of the fluorescent material particles being detected at the surface. The fluorescent material is sized to be smaller that the reservoir sand particles, and thus gives a good indication of gravel pack deterioration prior to sand breakthrough.

What is claimed is:

1. A method for detecting detonation of a tubing conveyed perforating (TCP) gun in a wellbore comprising:

(a) placing a sensor in a wellbore;

(b) detonating a TCP charge; and (c) detecting a change in an electrical property of a sleeve surrounding the TCP charge indicative of detonation of the TCP charge.

2. The method of claim 1, wherein the sensor comprises a tracer module containing a fluorescent tracer dye.

3. The method of claim 2, wherein the step of detecting detonation of the TCP charge in further comprising sensing tracer dye released from the tracer module upon detonation of the TCP charge.

4. The method of claim 1 wherein the sleeve comprises a fibre optic sleeve surrounding a TCP charge string in the wellbore.

5. The method of claim 4, wherein the step of detecting detonating of the TCP charge in further comprising sensing changes in the electrical properties of the fibre optic sleeve upon detonation of the TCP charge.

6. The method of claim 1 wherein the sensor comprises an acoustic sensor in the wellbore.

7. The method of claim 6 wherein the step of detecting detonation of the TCP charge further comprises acoustically sensing detonation of the TCP charge.

8. The method of claim 1, wherein the sleeve comprises a material that changes capacitance when the TCP charge detonates.

9. The method of claim 1, wherein material is removed from the sleeve when the TCP charge detonates.

10. An apparatus for detecting detonation of a tubing conveyed perforating (TCP) gun in a wellbore comprising:

a TCP charge and detonator deployed in the well bore;

a sleeve surrounding the TCP charge and a detonation sensitive device that senses a change in an electrical property of the sleeve to indicate the detonation of the TCP charge.

11. The apparatus of claim 10, wherein the detonation sensitive device comprises a fluorescent tracer dye module that releases the dye upon detonation of the TCP charge, the apparatus further comprising a fluorescent dye detector for sensing release of the fluorescent dye.

12. The apparatus of claim 10, wherein the sleeve comprises a fibre optic sleeve adjacent the TCP charge that changes electrical properties upon detonation of the TCP charge, the apparatus further comprising a sensor for detecting changes in the electrical properties of the fibre optic sleeve upon detonation of the TCP charge.

13. The apparatus of claim 10, wherein the detonation sensitive device comprises an acoustic sensor that acoustically senses detonation of the TCP charge.

14. The apparatus of claim 10, wherein the sleeve comprises a material that changes capacitance when the TCP charge detonates.

15. The apparatus of claim 10, wherein material is removed from the sleeve when the TCP charge detonates.

16. A system for detecting detonation of a tubing conveyed perforating (TCP) gun in a wellbore comprising:

a drill string comprising a TCP charge and detonator deployed in the well bore;

a sleeve surrounding the TCP charge; and a detonation sensitive device that senses a change in an electrical property of the sleeve to indicate the detonation of the TCP charge.

17. The system of claim 16, wherein the sleeve comprises a fibre optic sleeve adjacent the TCP charge that changes electrical properties upon detonation of the TCP charge, the apparatus further comprising a sensor for detecting changes in the electrical properties of the fibre optic sleeve upon detonation of the TCP charge.

18. The system of claim 16, wherein the sleeve comprises a material that changes capacitance when the TCP charge detonates.

19. The system of claim 16, wherein material is removed from the sleeve when the TCP charge detonates.

* * * * *